United States Patent [19]

Wrightman

[11] 4,392,520

[45] Jul. 12, 1983

[54] LOG BUILDING CONSTRUCTION

[76] Inventor: Ronald A. Wrightman, P.O. Box 268, Minden, Ontario, Canada, K0M 2K0

[21] Appl. No.: 243,516

[22] Filed: Mar. 13, 1981

[51] Int. Cl.[3] ..... B27B 1/02

[52] U.S. Cl. ..... 144/363; 83/432; 83/435.1; 83/869; 144/3 R; 144/85; 144/136 G; 144/204; 144/245 R

[58] Field of Search ..... 144/1 R, 3 R, 82, 84, 144/136 G, 136 H, 203, 204, 2 R, 198, 245 R, 86, 85, 89, 363, 367, 379; 83/435.1, 432, 869

[56] References Cited

U.S. PATENT DOCUMENTS

| | | | |
|---|---|---|---|
| 753,688 | 3/1904 | Edwards | 144/198 |
| 4,221,246 | 9/1980 | Grutter | 83/435.1 |

*Primary Examiner*—W. D. Bray

*Attorney, Agent, or Firm*—Fetherstonhaugh & Co.

[57] ABSTRACT

The invention relates to a machine for end notching logs and to a method for end notching logs so that they can be incorporated into an interlocking corner configuration in a log cabin building. The corner construction is of the ½ dovetail configuration and the machine is designed to make one notch, rotate the log and then make a second notch whereby the resulting machine made configuration can be incorporated into a joint that is secure and properly drained.

5 Claims, 8 Drawing Figures

LOG BUILDING CONSTRUCTION

This invention relates to a method and to a machine for cutting the ends of logs with a dove-tail configuration for the purpose of making a log building.

Log buildings are popular. They are constructed from logs usually six to eight inches thick and have the attribute that the inner face of the log constitutes the finished interior wall of the building. Thus, a building constructed from appropriately finished logs has a finished outside and inside wall constituted by the outer face and inner face of the log.

Logs for a log building must be cut from mature trees. These trees are becoming scarce and the cost of these timbers is increasing to the point where, having regard to the cost of the lumber combined with the cost of labour to build it into a log building, a log building is becoming relatively expensive when compared with alternative constructions.

The corners of a well built log home are dove-tailed. The traditional dove-tail corner design is adapted to tighten with age and to repel water. In pioneer days the ends of the logs were cut with a dove-tail configuration by hand. The method was very slow and it is very doubtful that one could construct a competitively priced log building today using the hand method of forming the dove-tail corner.

Builders, taking advantage of modern wordworking equipment, have cut the dove-tail corners with power saws and jigs. They have done this with a view to reducing the cost of forming the corners and thereby reducing the overall cost of the log building.

The traditional dove-tail originally designed to tighten with age and to repel water was in the nature of a half dove-tail configuration when viewed from a face of the log. However, those who have applied modern machinery to the cutting of the dove-tail corner of a log building have not been able to achieve the traditional dove-tail corner formation because of limitations in their method and/or cutting machinery. They have compromised for a dove-tail corner wherein the dove-tail configuration is a full dove-tail at the face of the log. Such a configuration tends to admit drainage moisture and to be prone to the onset of wood rot. If the corners of a log building should become rotten the entire building will shortly deteriorate and have to be replaced or substantially repaired. Further, the machine methods devised to date are relatively cumbersome and costly.

Thus, the position of log buildings today is that the presently developed means for making them with the use of machinery does not produce the best construction and it still results in a building that is relatively expensive.

This invention relates to a method of forming a dove-tail corner of a log building wherein the traditional dove-tail formation is achieved. The method employs power equipment and achieves savings in time and labour that contribute to a significant reduction in the overall cost of a log building. The corners are formed accurately to achieve a tight joint. With the method it is possible to construct a log building at a cost that is favourably comparable to a building made from other contemporary building materials. This represents a substantial improvement in the art because the cost of good log buildings prior to this invention was reaching a point where they were not price competitive with buildings constructed from other materials.

In addition to providing a construction that is economic, the invention provides a construction that tightens with age and repels water. It thus avoids the likelihood of the occurance of rot at the corners. The method of notching the end of a log at its upper and lower edge to make a dove-tail formation for a log building according to this invention comprises the steps of projecting the log longitudinally of itself onto a cradle, and arresting the projection of the log to cause a free end of the log to project a predetermined amount beyond the cradle; clamping the log so positioned in the cradle; moving the cradle in a direction transversely of the direction of the longitudinal axis of the log for operative engagement by four saw blades which are mounted in predetermined relation to the path of the cradle to notch the upper edge of the log and the lower edge of the log whereby to form a dove-tail configuration; each of the notches being defined by a side formed by a transverse cut and by a side formed by a longitudinal cut that intersects the transverse cut at a corner.

A machine according to the invention comprises a carriage; guide means for the movement of the carriage to maintain it on a predetermined path; means for moving the carriage back and forth on the guide means; a cradle for a log on said carriage; means for locating a log in said cradle with a free end in a predetermined relationship to a side edge of the predetermined path of said carriage; saws mounted in predetermined relationship to the predetermined path of the carriage to engage with the free end of a log and notch the upper edge and the lower edge thereof to form a dove-tail configuration; each of said notches being defined by a side formed by a transverse cut in the log and by a side formed by an intersecting longitudinal cut that intersects the transverse cut at a corner. The invention will be clearly understood after reference to the following detailed specification read in conjunction with the drawings.

In the drawings

Figure 1:
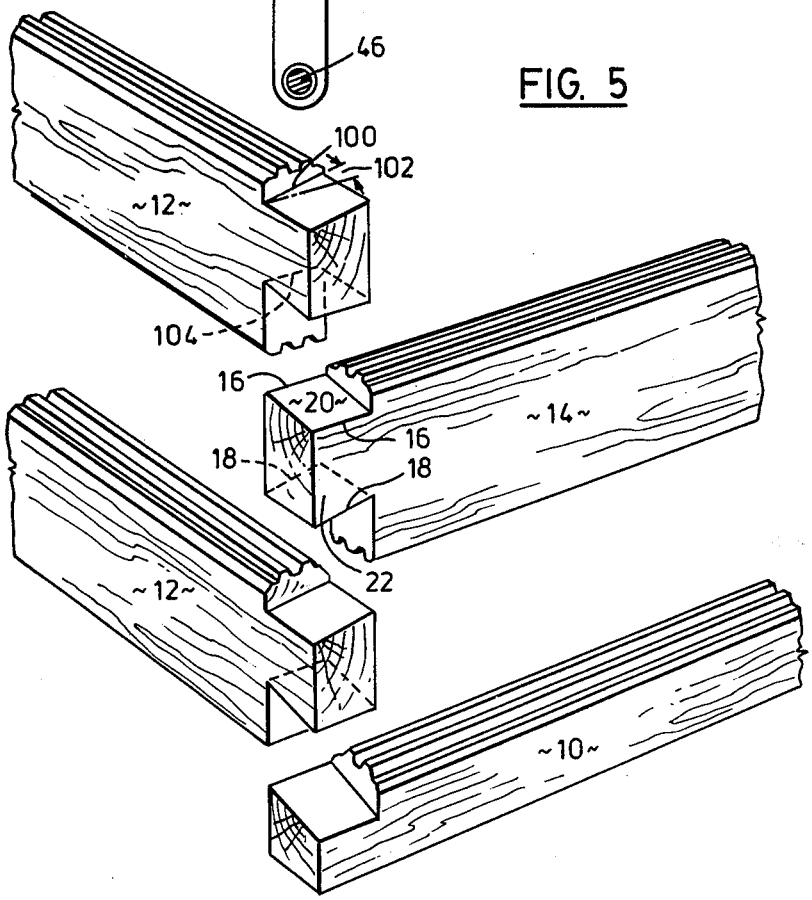
FIG. 1 is an exploded view of the end portions of four logs that constitute a portion of the corner of a log building.
Figure 2:
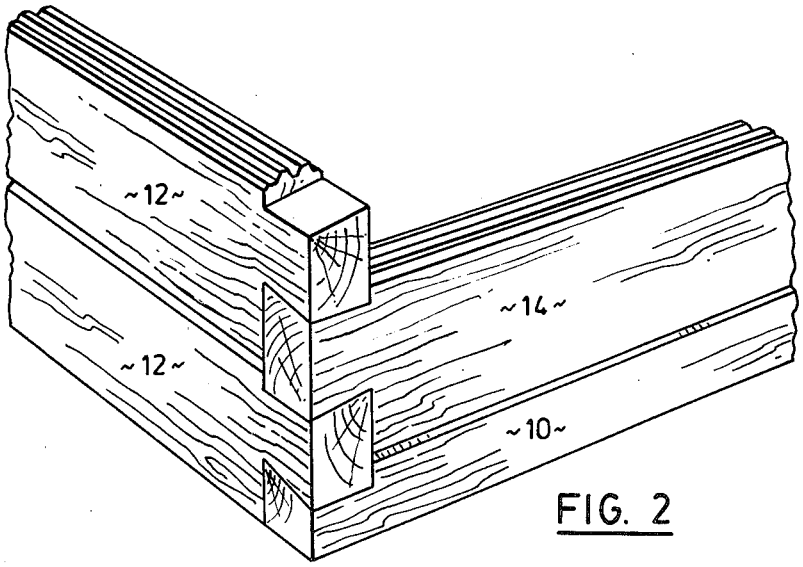
FIG. 2 is an illustration of the same logs assembled into a corner.

In FIGS. 1 and 2 the numerals 10, 12 and 14 refer to the ends of logs of a portion of the corner configuration of a log building. The ends of the logs 12 and 14 (which are the same except as to hand) are end notched at their upper and lower edges to achieve a dove-tail configuration that forms a tight corner interlock for building as a whole. Log 10 is a starter log. The dove-tail configuration illustrated is a ½ dove-tail in the sense that the upper longitudinal edges 16 thereof are horizontal and parallel to the longitudinal axes of the log. The lower edges 18 slope downwardly towards the free end of the log.

The side 20 of the upper notch slopes downwardly from the inner face of the log to the outer face of the log. The purpose of this is to insure that water at the joint will drain towards the outside of the building. The side 22 of the end notch in the lower edge of the log slopes downwardly towards the end of the log. This also is for drainage. In the case of each notch drainage is towards an outside wall surface of the building.

This dovetail configuration is not new but no one has been able to cut it on production power machinery. It has tended to fall into disuse in modern construction because of the inability to make it accurately with available equipment at a cost that is competitive. This invention is concerned with a method and a machine for end notching a log efficiently with this and other dove-tail configurations.

Figure 3:
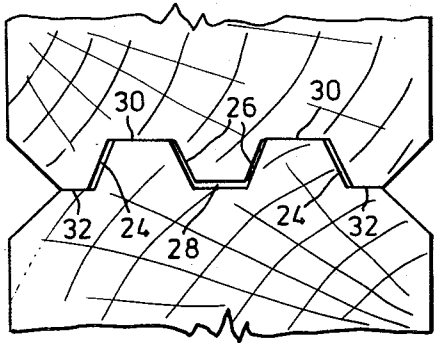
FIG. 3 is an illustration of the ends of two logs resting one upon the other in assembled relation.

The invention will be described in association with the dove-tail joint illustrated but it will be understood that it is intended to apply to other configurations when it is of advantage. The logs of FIG. 1 are illustrated in a corner assembly in FIG. 2. FIG. 3 is a view illustrating the tongue and groove interlock at the edges of the log. A sealant is applied to clearance spaces 24, 26 and 28. The logs sit wood to wood at 30 and 32. This arrangement assures solid foundation for the stack of logs and tight sealing. No packing is required on the outside grooves between the logs. Sealant is also applied to the surfaces of the notches at the dove-tail corners. This invention is not concerned with the tongue and groove configuration of itself nor is it concerned with the assembly of the logs into a building. These aspects are therefor not dealt with in detail in this specification.

Figure 8:
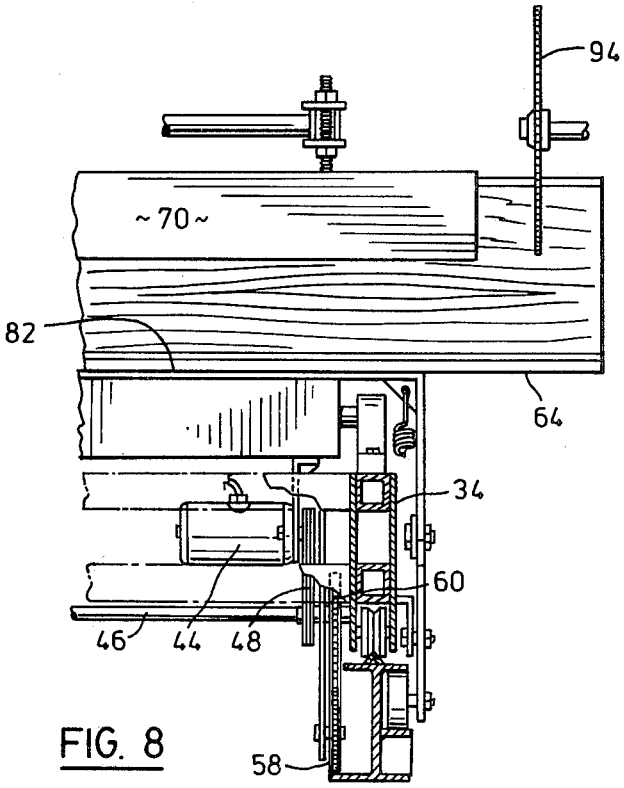
FIG. 8 is an illustration along the line 8—8 of FIG. 7.
Figure 4:
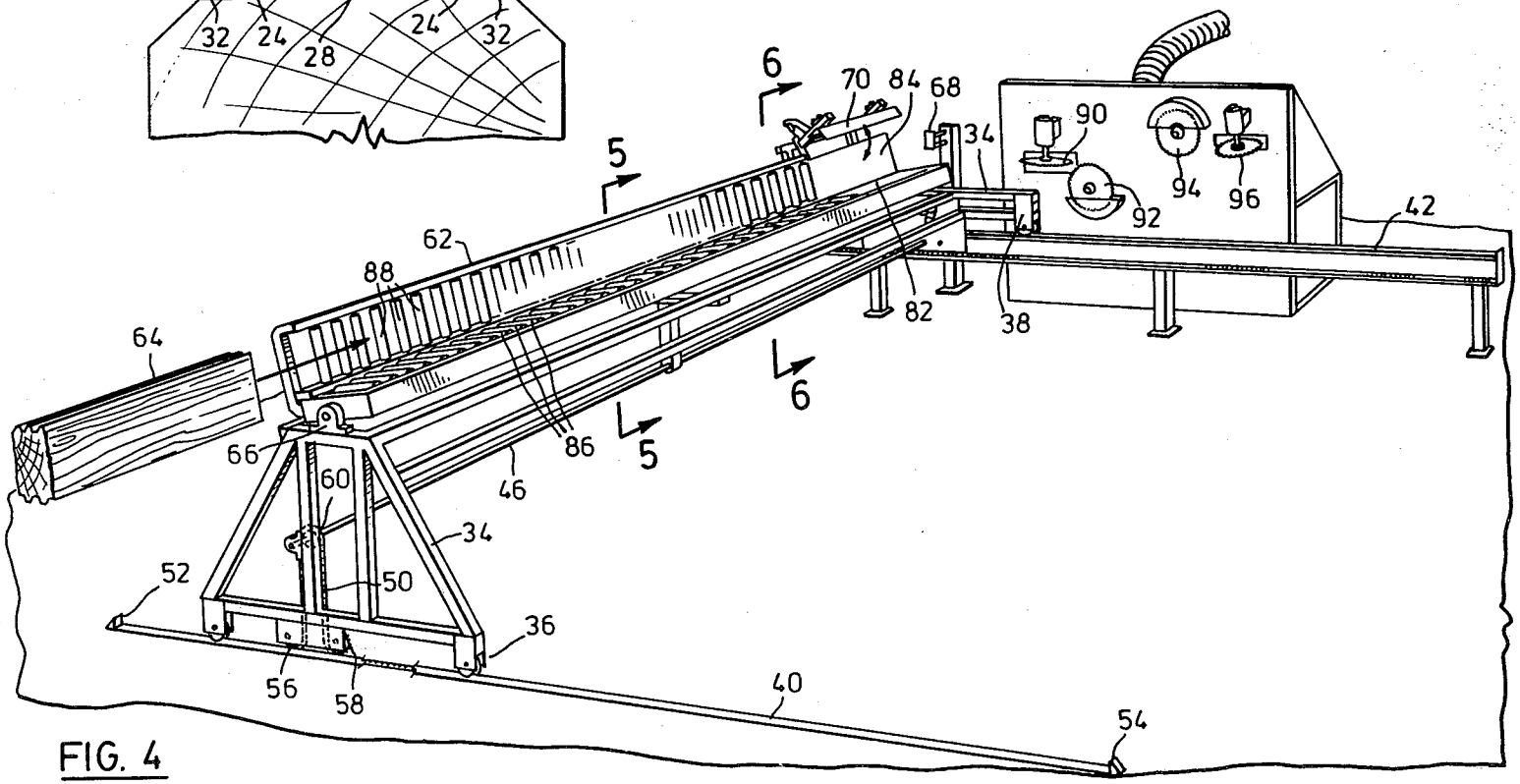
FIG. 4 is an illustration of an apparatus for notching a log with a dove-tail configuration.

FIG. 4 is a general illustration of a machine designed to end notch a log. It has a carriage 34 wheeled at each end as at 36 and 38 to run back and forth along tracks 40 and 42 under the power of a hydraulic motor 44 (FIG. 8). Shaft 46 is journalled for rotation in the carriage and driven by motor 44 through belt drive 48. A chain 50, secured at each end to an end of each track as at 52 and 54, passes around sprockets 56 and 58 and sprockets 60. It will be apparent that as shaft 46 and its sprockets 60 are turned by the motor 44 that the carriage 34 will be carried along the tracks 40 and 42. The drive arrangement is similar at each of the two tracks so that there is even drive power applied to both sides of the carriage 34. Motor 46 is controlled to operate in one direction to move the carriage in one direction along the track and when the carriage is at the end of the track to reverse direction to move the carriage back along the track.

A cradle 62 adapted to receive a log 64 to be end notched is mounted on the carriage 34. It is pivotably mounted at each of its ends in a bearing similar to the bearing 66. It has a bottom and a back surface fitted with conveyor rollers of conventional design so that a heavy log 64 can be projected thereon and conveyed laterally thereof with minimum of effort. A stop member 68 locates the log in the carriage with its free end portion in predetermined relation to the edge of the carriage and the track 42.

Figure 5:
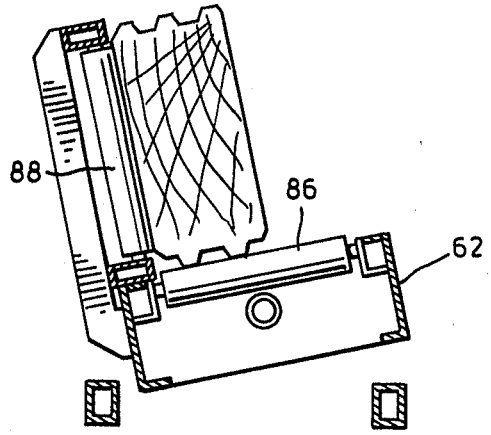
FIG. 5 is a view along the line 5—5 of FIG. 4.
Figure 5:
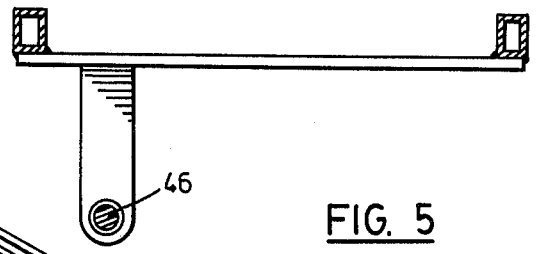
Figure 6:
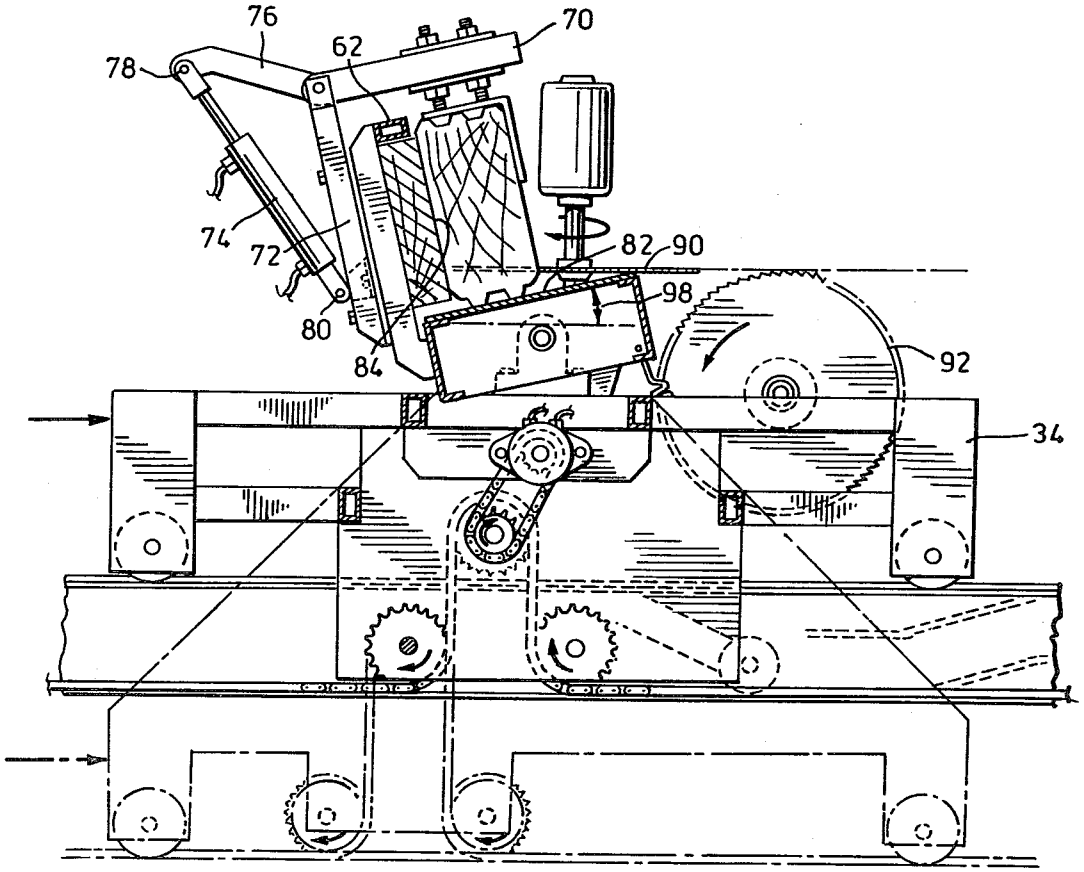
FIG. 6 is a view along the line 6—6 of FIG. 4.

A clamp 70, pivotally mounted with respect to support 72 on the back of the cradle 62 is actuated between an open position illustrated in FIG. 4 to a closed position in FIG. 6 to clamp a log securely against movement in the cradle. The clamp 70 is operated by hydraulic cylinder 74 (FIG. 6) that pivotally connects at one end with the crank arm 76 as at 78 and at its other end with the cradle as at 80. It will be noted that the end of the cradle surfaces in the area of the clamp 70 is smooth as at 82 and 84 to give more secure clamping. The configuration of the cradle in the portion that is of a roller conveyor nature is illustrated in FIG. 5 where the rollers are indicated by the numerals 86 and 88.

Thus, a log 64 is projected onto the cradle 62 of the carriage 34 until it engages the stop 68. In this location the clamp 70 is operated from the open position to the closed position illustrated in FIG. 6 to securely clamp the log in position in the cradle. It will be noted that as clamped initially the cradle is tilted rearwardly as illustrated in FIG. 6 of the drawings. Subsequently, in the operation of the embodiment of the invention illustrated the cradle is turned within its axis to cause the log to assume a position in which its front and rear face are vertical. This will be referred to later in the specification.

It has been explained in the specification how the carriage 34 is moved forwardly and rearwardly of the tracks 40 and 42 through the operation of the motor 44 and the drive shaft 46. As it carries the log forward the end of the log is notched at its upper edge and at its lower edge through the operation of four saw blades 90, 92, 94 and 96. These saw blades are each operated by means of an electric motor and they are each rigidly mounted with respect to the track 42. They are disposed a distance from the end of the log that has been clamped in a preselected position with respect to the carriage to accurately cut the notches that form the half-dove-tail in the end of a log.

The log 64 is projected onto the cradle 62 with its upper edge down and as it is moved forwardly through the movement of the carriage on the tracks 42 and 54 it is engaged first by saw blade 90 that cuts the surface 20. It is next engaged by the saw blade 92 which makes the transverse cut that removes the notch that forms the notch in the upper surface of the log. In this respect it will be recalled that the faces of the log are inclined rearwardly as viewed in FIG. 6. The angle of rearward inclination of the carriage to the horizontal is indicated by the numeral 98 in FIG. 6. In the finished log the notch that is formed by the cutting blades 90 and 92 has sides defined by the transverse cut formed by blade 92 and by the intersecting longitudinal cut formed by the blades 90 that intersect at a corner 100. In the finished log the corner 100 is inclined to a horizontal line at an angle 102 as viewed in FIG. 1 that is equal to the angle 98.

The corner 104 between the sides of the notch formed in the bottom edge of the log is horizontally disposed when the log is in a position as illustrated in FIG. 1. The transverse cut at this corner is formed by blade 94 from the upper edge of the log as viewed in FIG. 1. It will be appreciated that the log is mounted in the carriage with its lower edge in an uppermost position. As the log travels between saw blade 92 and saw blade 94 the cradle 62 of the carriage 34 is rotated within the carriage to move the carriage through the angle 98. Thus, as the saw blade 94 makes the transverse cut that results in the location of the corner 104, the corner 104 is formed at an angle of inclination to the corner 102 at an angle equal to the angle 102 and also to the angle 98. Blade 96 completes the longitudinal cut necessary to form the notch in the lower edge of the log.

Thus, as the carriage carries the clamped log forward past the blades 90, 92, 94 and 96 the end of the log is notched at its upper and its lower surface to form the half dove-tail formation described above. Once the carriage reaches the outer extremity of its travel it returns to its original position. As it returns to the original position the cradle thereof is reinclined to assume the position illustrated in FIG. 6.

Figure 7:
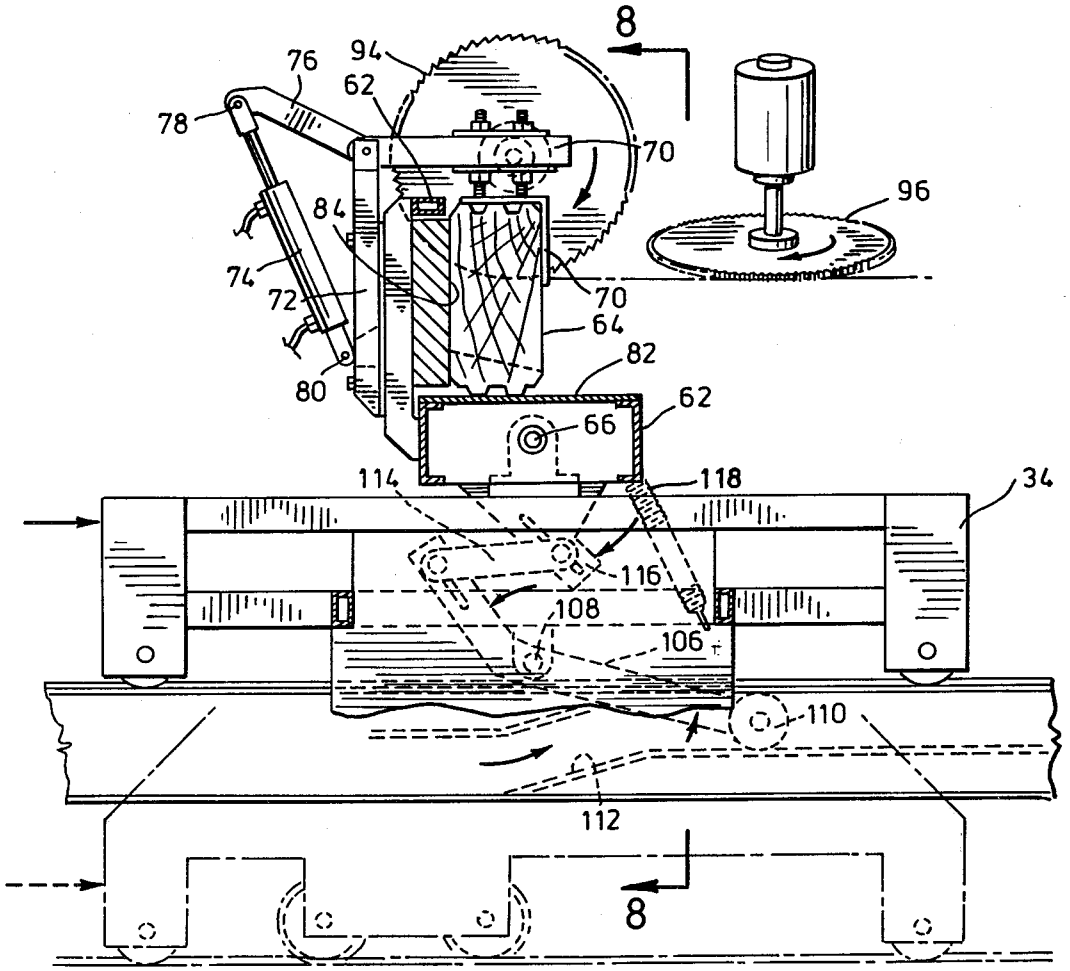
FIG. 7 is an illustration of an end of the machine showing the manner in which the log cradle is turned between engagement by two of the saws.

The means for moving the cradle from its rearwardly inclined position illustrated in FIG. 6 to its normal position as the carriage moves forward and for returning it to its inclined position as the carriage moves rearwardly is illustrated in FIG. 7. In that figure the cradle 62 is indicated in a horizontal position with the bottom surface horizontal. The saw blade 94 is illustrated as it makes the transverse cut to define the corner 104 of the notch in the lower side of the log. A lever 106 pivotally mounted to the carriage 34 as at 108 has a cam follower wheel 110 at its free end that rides along the track 112. As the carriage moves forward the cam follower wheel of the lever 106 engages the rise of track 112 and moves the lever in a counterclockwise direction about its pivot point 108. As it does this it carries link 114 in a rearward direction. Link 114 in turn pulls lever arm 116 in a clock-wise rotation about the pivotal axis of rotation 66 of the cradle 62 to carry the cradle 62 in a clock-wise rotation about its pivotal axis to the position illustrated in FIG. 7. Lever arm 116 is rigidly connected to the cradle 62. Spring 118 is in tension and is designed to assist the action of the lever 106 in tilting the cradle from the inclined to the horizontal position. The link 114 pivotally connects with the lever 106 and the lever arm 116 does not slide within the slots indicated. The position of the pivotal connection in each case can, however, be adjusted by movement within the slots.

Thus, as the carriage moves from back to front the cam follower wheel 110 engages with the track 112 and lever 106 moves in a counterclockwise direction to move the cradle from an inclined to a horizontal position. As the carriage moves in a rearward direction the cam follower goes down the track 112 and the cradle 62 returns to its inclined position. The movement between the two positions in each case takes place between the locations of blades 92 and 94.

From the foregoing it will be apparent that with this invention one can efficiently notch the end portions of logs to form the corner construction illustrated in FIGS. 1 to 3. The machine illustrated notches for one hand on logs on one side of the building. A similar machine wherein the logs are projected onto the cradle from the opposite direction is necessary for the logs on the adjacent side of the building.

The manner of projecting a log into the cradle of the machine by means of the longitudinally extending roller conveyors until they reach the stop means that locates them accurately with respect to the saw blades is a very efficient manner of setting the log up for corner formation. By reason of the rotating of the log as it passes between saw blade number 2 and saw blade number 3 one is able to automatically make a half dove-tail construction that approaches in form the traditional method of forming a notched corner in a log building. It will be noted that the edges of the logs are formed with a complimentary tongue and groove construction and that in the assembled position the logs rest upon each other in a wood to wood basis as at the numeral 30 and 32 in FIG. 3. The sealant is on side surfaces as at 24 and at 28. With this tongue and groove arrangement a tight wood seat is achieved that does not settle and the joint is sealed by the sealant in the spaces 24 and 28.

In the cutting of a building one works from a plan and cuts the logs around the perimeter of the building and assembles them in the form of the building as they are cut. The logs so assembled are numbered and after the cutting is complete one removes the stack and reassembles them at the location intended. The ends of logs in the middle of a wall are appropriately joined. Thus, it is possible to precut a building. It has been found that the saw blades are capable of cutting the corner configuration with sufficient accuracy to permit this kind of preassembly. With this construction one can finally assemble a building at the site with a minimum of labour so that the cost of a log building as a whole is not appreciably greater and may, in some cases, be less than a comparable building of other conventional forms of construction. In the site assembly sealant is, of course, applied. The advantage of the log construction, of course, is that the log surfaces are finished inside and out in final form and only require staining after having been erected. Detail other than of the corner is not described in detail because it is variable within the art and not part of this invention. Modifications of the embodiment of the invention illustrated will be apparent to those skilled in the art and it is not intended that the foregoing description should be read in a limited sense.

The embodiments of the invention in which an exclusive property or privilege is claimed are defined as follows:

1. A machine for end notching the upper edge and the lower edge of a log to achieve a dove-tail configuration comprising:

a carriage;

guide means for the movement of the carriage to maintain it on a predetermined path;

means for moving the carriage back and forth on the guide means;

a cradle for a log on said carriage;

means for locating a log in said cradle with a free end in a predetermined relationship to a side edge of the predetermined path of said carriage;

four saws mounted in predetermined relationship to the predetermined path of the carriage to engage with the free end of a log and notch the upper edge and the lower edge thereof to form a dove-tail configuration;

each of said notches being defined by a side formed by a transverse cut in the log and by a side formed by an intersecting longitudinal cut that intersects the transverse cut at a corner;

said four saws each being rigidly mounted; each of said four saws being adapted to make one only of said cuts, said cradle being rotatable through a predetermined angle to turn the transverse axis of a log cradled therein through a predetermined angle during the movement of said carriage between the saw blade that makes transverse cut for the notch in one edge of the log and the saw blade that makes the transverse cut for the notch in the other edge of the log whereby the corner of one notch formed in a log can be inclined to the corner of the other notch formed in a log.

2. A machine for end notching the upper edge and the lower edge of a log to achieve a dove-tail configuration comprising:

a carriage;

guide means for the movement of the carriage to maintain it on a predetermined path;

means for moving the carriage back and forth on the guide means;

a cradle for a log on said carriage;

means for locating a log in said cradle with a free end in a predetermined relationship to a side edge of the predetermined path of said carriage;

four saws mounted in predetermined relationship to the predetermined path of the carriage to engage with the free end of a log and notch the upper edge and the lower edge thereof to form a dove-tail configuration;

each of said notches being defined by a side formed by a transverse cut in the log and by a side formed by an intersecting longitudinal cut that intersects the transverse cut at a corner;

said cradle having a pair of support surfaces, one of said support surfaces being adapted to support an edge of said log and the other of said support surfaces being adapted to support a face of said log, at least one of said support surfaces comprising a roller conveyor adapted to receive a log as it is projected longitudinally of itself onto said surface.

3. A machine for end notching the upper edge and the lower edge of a log to achieve a dove-tail configuration as claimed in claim 2 in which each of said support surfaces is a roller conveyor.

4. A method of notching the end of a log at an upper edge and at a lower edge to make a dove-tail formation for a log building by the steps of:

projecting the log longitudinally of itself onto a cradle, and arresting the projection of the log to cause a free end of the log to project a predetermined amount beyond the cradle;

clamping the log so positioned in the cradle;

moving the cradle in a direction transversely of the direction of the longitudinal axis of the log for operative engagement by four saw blades which are mounted in predetermined relation to the path of the cradle to notch the upper edge of the log and the lower edge of the log whereby to form a dove-tail configuration;

each of the notches being defined by a side formed by a transverse cut and by a side formed by a longitudinal cut that intersects the transverse cut at a corner;

the corner of one notch being inclined a predetermined angle to the corner of the other notch and said log being rotated about its longitudinal axis through said predetermined angle between making the transverse cut of one notch and making the transverse cut of the other notch to incline the corners of said notches at said predetermined angle as aforesaid.

5. A method of notching the end of a log at an upper edge and at a lower edge to make a dove-tail formation for a log building by passing it across a series of four rigidly mounted saws to make four cuts; each notch being defined by a side formed by a transverse cut and by a side formed by an intersecting longitudinal cut that intersects the transverse cut at a corner; the corner of one notch being inclined at a predetermined angle to the corner of the other notch; each of said saws being adapted to make one of said four cuts; rotating said log about its longitudinal axis through said predetermined angle between making the transverse cut of one notch and making the transverse cut of the other notch to incline the corners of said notches at said predetermined angle as aforesaid.

* * * * *